US005806157A

United States Patent [19]

Lindblom

[11] Patent Number: 5,806,157

[45] Date of Patent: Sep. 15, 1998

[54] WARP THREAD DRAWING IN METHOD AND APPARATUS

[75] Inventor: Bo Lindblom, Osby, Sweden

[73] Assignee: Texo AB, Almhult, Sweden

[21] Appl. No.: 708,261

[22] Filed: Sep. 6, 1996

[30] Foreign Application Priority Data

Sep. 19, 1995 [SE] Sweden ..... 9503248

[51] Int. Cl.[6] ..... B65H 1/00

[52] U.S. Cl. ..... 28/208; 28/201; 139/1 R

[58] Field of Search ..... 28/201, 204, 208; 139/1 R

[56] References Cited

U.S. PATENT DOCUMENTS

| | | | |
|---|---|---|---|
| 4,910,837 | 3/1990 | Fujimoto et al. | 28/201 |
| 5,116,276 | 5/1992 | Takegawa et al. | 139/351 |
| 5,371,930 | 12/1994 | Lindenmueller . | |
| 5,394,596 | 3/1995 | Lindenmuller et al. | 28/201 |

FOREIGN PATENT DOCUMENTS

| | | | |
|---|---|---|---|
| 0 392 469 | of 1990 | European Pat. Off. . | |
| 38 28 730 | of 1989 | Germany . | |
| 2-264040 | 10/1990 | Japan | 139/1 R |
| 663 040 | of 1987 | Switzerland . | |
| 697 871 | of 1992 | Switzerland . | |

*Primary Examiner*—Andy Falik

*Attorney, Agent, or Firm*—Pollock, Vande Sande & Priddy

[57] ABSTRACT

A method of warp thread drawing-in for warp thread machines having at least one warp thread magazine, heald frame, and reed comprises the steps of placing the warp thread magazine, heald frame and reed from the warp thread machine on a warp thread charging device which is separate from the warp thread machine; passing warp thread groups, comprised of one or more warp threads, in stages through a respective heddle of a heald frame; assigning each of the warp thread groups a space in the reed; drawing each of the warp thread groups through its respective space with an automatic reeding device, the automatic reeding device being movable along a width of the reed as the drawing step is carried out; transferring the warp thread magazine, heald frame and reed from the warp thread charging device to the warp thread machine and returning the warp thread magazine, heald frame and reed to their operational positions in the warp thread machine. A warp thread charging apparatus is also disclosed.

18 Claims, 5 Drawing Sheets

WARP THREAD DRAWING IN METHOD AND APPARATUS

FIELD OF THE INVENTION

The present invention relates to a method for substantially improving the efficiency of warp thread drawing-in work in a harness-type weaving machine which is intended for weaving large widths, which in this case signifies weaving widths of 8 to 30 meters or wider. The weaving machine comprises warp thread magazines, heald frames, and reed (s). In warp thread drawing-in work, warp thread groups which can each comprise one or more threads, are passed through a respective heddle in the respective heald frame in question, are assigned their own spaces (dents) in the reed (reeds) and are drawn through the spaces by means of one or more automatic reeding devices, which are moved along the width(s) of the reed or reeds as the drawing-through is carried out. The invention also relates to a harness machine arrangement intended for weaving large weaving widths and provided with warp thread magazines, heald frames, and reed(s). The invention additionally relates to warp thread charging equipment which can be arranged at a separate site or station from one or more harness machines of the type in question.

BACKGROUND OF THE ART

In the case of weaving machines of this kind intended for weaving large widths, it has been proposed to carry out the warp thread drawing-in work or the warp thread replacement in the actual weaving machine, which is made up of heavy components and a framework for supporting these components. When replacing warp thread, the existing warp is first taken apart, and the new warp is then drawn in. As examples of weaving machines of this type, reference is made to the TM 300 or TM 400 weaving machines which are sold on the market by TEXO AB of Sweden.

In the case of these weaving machines, it is already known within the textile industry to prepare the warp thread replacement alongside the existing weaving machine and, accordingly, to replace components concerned in the warp thread drawing-in with components compatible with the warp thread arrangement applied.

In the case of warp thread replacement, according to the earlier technique in large weaving machines, it is known to use automatic reading devices and control arrangements for inserting and checking the warp thread.

DESCRIPTION OF THE INVENTION

TECHNICAL PROBLEM

In the case of harness machines, for example, for weaving cloth with weaving widths of the abovementioned type, it is well known that the drawing-in of new warp during warp replacement is a demanding procedure from the point of view of both personnel and time. Warp replacement can take up to 5 to 6 weeks and can unduly occupy both personnel and weaving machine resources. The invention aims to solve this problem among others.

There is a requirement to utilize personnel resources in a better way, to minimize these resources, and to maintain a highly efficient weave production in which the actual periods of utilization of the weaving machines and of the personnel are shortened. The invention also solves this problem.

There is also a need to provide user-friendly and ergonomically sound work-stations for the personnel operating the weaving machine equipment. Warp thread replacement using present-day weaving assemblies and weaving machines is often technically complicated and difficult to perform due to the present-day designs and arrangements of the weaving machines. Confined spaces in the premises used contribute to complicating the warp thread replacement. The present invention solves this problem too.

There also a need for improvement in weaving machine structure an the principles of warp thread replacement so that those persons forming warp thread replacement teams can specialize in this task and carry out the work in different weaving factories. The invention solves this problem too.

There is a desire that the machine manufacturer should preferably sell the method for the woven material rather than weaving machines themselves. In order to satisfy this demand, the weaving procedure must be divided into modules, and the various modules, of which, for example, warp thread replacement constitutes one module, must be made readily available from the weaving factory's exterior/boundary. The invention solves this problem too.

In warp thread replacement, it is important that the control work concerning correctly inserted warp thread can be carried out effectively. According to the invention, this is achieved, by the use of a control carriage which is displaceable along the reed or the reeds on the warp thread drawing-in equipment. It is important that this be designed and used in an efficient and appropriate way. The invention solves this problem too.

Warp thread replacement and warp thread drawing-in at a station which is separate from the actual weaving machine or weaving machines has been met with opposition because of the heavy components which must be moved, the sizes of the warp thread mass or warp thread masses, and the complexity of some weave patterns. The present invention also solves this problem and teaches a new mode of warp thread replacement even in large weaving machines (15 tons or more) where the weight of the components which are to be lifted and transferred to the weaving machine in question is of the order of 2 to 5 tons. The invention solves this problem too.

When carrying out warp thread replacement, the components at the warp thread drawing-in station have to be assembled and lifted together with the drawn-in warp thread, which, particularly in the case of a warp thread, magazines in bobbin form, entails a large number of components whose mutual relationships and positions must not be inadvertently disturbed. This places particular demands on the lifting apparatus. The invention solves this problem too.

SUMMARY OF THE INVENTION

The present invention method is characterized in that the warp thread magazines, heald frames and reed are arranged in warp charging equipment which is separate from the harness machine and which is arranged with a free space in front of the reed or the reeds. The warp thread magazines, the heald frames and the reed/reeds, together with the drawn-in warp thread arrangement belonging to these components, are then transferred to the harness machine's bearing elements for components and are arranged in their respective places in the harness machine.

In one embodiment, the warp thread insertion is checked, as the warp thread drawing-in is carried out, by means of a control unit simulating a cloth beam function, on which a number of threads placed in the heald frames or the reed or reeds are mounted for control purposes, and the control unit is moved along the widths of the reed or reeds as the control is carried out. In the warp thread charging equipment, the heald frames are acted on to perform shedding movements, and during the checking by means of the control unit, weft threads are passed through the sheds and the weave pattern is, in this way, exposed for visual control or other control at the respective part of the weave width.

In one embodiment for warp thread replacement, the warp thread draft present in the harness machine is removed, together with first warp thread magazines, heald frames and reed, and second warp thread magazines, heald frames and reed are applied, together with the warp thread arrangement inserted in the warp thread charging equipment. The warp thread magazine can have the form of bobbins mounted on one or more warp thread magazine beams. During the application of the new warp thread arrangement, the beam or the beams is/are uncovered. The bobbins which are transferred from the station are set up in boards, and the beam or beams is/are pushed through central openings in the bobbins thus set up in the boards.

An apparatus according to the invention can principally be characterized in that, for the purpose of permitting more efficient warp thread replacement, first warp thread magazines, heald frames and reed/reeds are arranged for dismantling from the harness machine after optional demolishing of the existing warp thread, and in that second warp thread magazines, heald frames and reed or reeds, together with a new, drawn-in warp thread arrangement belonging to these second components, are arranged such that they can be fitted together with the warp thread arrangement in the harness machine at the places of the first components.

In one embodiment, the warp thread magazines have the form of bobbins which are arranged or can be arranged on warp thread magazine beams and which can be threaded from the ends of the beams in the case of exposed beams, or alternatively, the bobbins can be set up in boards or equivalent and the beam or beams can be introduced through central openings in the bobbins set up in the boards.

The warp thread charging equipment according to the invention is principally characterized in that warp thread magazines, heald frames and reed or reeds can be placed in the warp thread charging equipment and consist of or are compatible with the warp thread magazines, the heald frames and the reed or reeds in one or more of the harness machines, and a new warp thread arrangement intended for one of the harness machines can be drawn into the warp thread charging equipment. Furthermore, the warp thread charging equipment is designed to permit removal of the positioned warp thread magazine, heald frames and reed or reeds, together with the new, drawn-in warp thread arrangement.

In one embodiment, the warp thread charging equipment is arranged with a free space in front of the reed or reeds, and an automatic reeding device accessible from the free space is driven along the entire width or widths of the reed or reeds as the drawing-in work is performed. In a further embodiment, a control carriage simulating a cloth beam function is used. The carriage can be driven along the entire width or widths of the reed or reeds. The control function for correct insertion in the heddles of the heald frames concerned and the spaces (dents) of the reed can be carried out on relatively few warp threads at a time, for example 50 to 100.

In a further embodiment, heald frames included in the warp thread charging equipment are arranged to effect shedding movements. By means of weft thread arrangements disposed on the control carriage, or related to the control carriage function, weft threads can be introduced into the resulting sheds, whereupon visual control or other control of correct warp thread insertion can be effected. The control carriage is arranged so that controlled warp threads are fixed upon execution of the control function.

In one embodiment, the equipment comprises a lifting unit which is provided with first lifting members for the heald frames, second lifting members for the reed or reeds, and third lifting members for the warp thread magazines. The lifting unit can be lifted by means of traverse crane, truck, or similar lifting member. The first lifting members can, in this case comprise clamp attachments for the heald frames, the second lifting members can comprise one or more lifting eye bolts for the reed or reeds, and the third lifting members can comprise eyes for belt straps or equivalent which can cooperate with the warp thread magazines in the form of bobbins.

By means of what has been proposed above, the warp thread replacement can be divided into modules and located outside the weaving machine at a replacement station. The latter can be designed to be ergonomically correct for the personnel, who can be utilized effectively in the weaving factory. Since the weaving machines run satisfactorily, the personnel can be employed in preparing the warp thread replacement in the weaving machine as it is running, which makes the work more varied. Warp thread replacement in one or more weaving machines at one and the same time can also be planned in advance in a completely different way and does not need to mean the shutdown of the weaving machines for long periods. The drawing-in work itself can be carried out without the design and construction of the weaving machine impeding the actual work, which, with the novel method and apparatus, can now be reduced to about 24 hours in the case of weaving machines of the stated sizes, as compared with 5 to 6 weeks in known cases today. The warp thread drawing-in work has been facilitated by known automatic reeding device and with control members which simulate a cloth beam and which are easy to access and manuver by virtue of the free space in front of the reed or reeds. As a result of the specific lifting arrangement, the lifting from the station over to the weaving machine can be performed efficiently and safely. The weaving machine can still be designed with the same components and does not need to undergo extensive construction changes.

BRIEF DESCRIPTION OF THE DRAWINGS

The method, the apparatus and the equipment according to the invention will be described hereinbelow with reference being made at the same time to the attached drawings, in which:

FIGS. 5–7 and FIG. 5*a* show, in different views, a lifting apparatus for transferring warp thread magazines, heald frames and reed/reeds from the equipment according to FIG. 4 to the weaving machine.

DETAILED DESCRIPTION OF THE PREFERRED EMBODIMENT(S)

Figure 1:
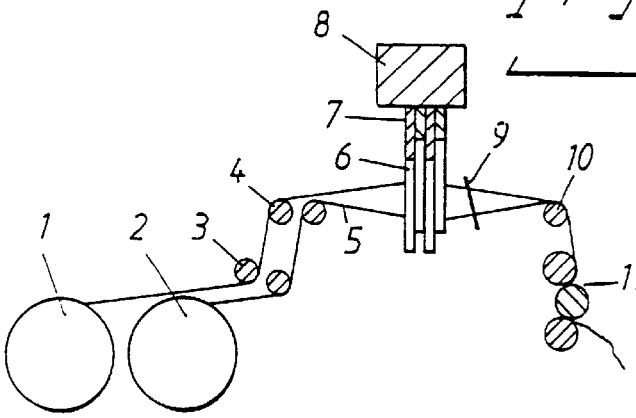
FIGS. 1 to 3 show, in longitudinal section, three different operating and dismantling stages for a weaving machine.
Figure 2:
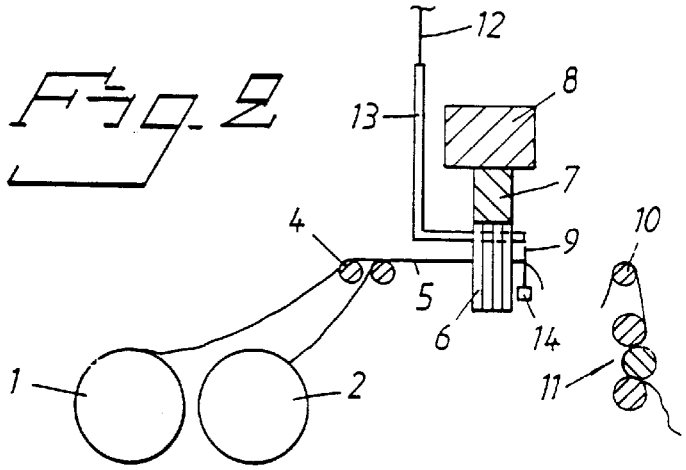
Figure 3:
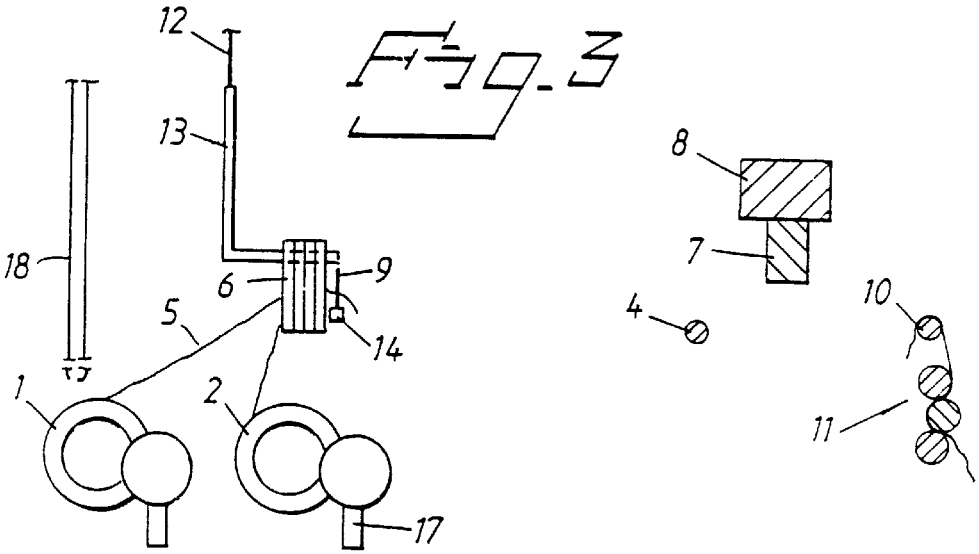

FIGS. 1 to 3 show the basic structure of a weaving machine sometimes referred to as a warp thread machine, for example in the form of the machine from TEXO AB as specified above. Only those parts that the invention is concerned with are shown. First and second warp thread magazines arranged rotatably with or on warp beams are indicated by 1 and 2. Guide rollers are shown by 3, and back rests by 4. The warp threads are represented by 5. Heald frames 6 are joined via a linkage system 7 to a superstructure 8. A reed is symbolized by 9, and a breast beam by 10. The cloth beam arrangement is shown by 11. FIG. 1 shows the weaving machine in the weave position.

FIG. 2 shows a first stage of dismantling of the components in question. During the dismantling, a traverse wire 12, a lifting yoke 13 (see below) and a holder 14 for the reed are used. The heald frames 6 have been moved to their central positions according to the figure, and are locked together for clear mutual positions during lifting and transport. The lifting yoke 13 is introduced into the heald frames 6 and locked tight to these. The tight locking can be effected in a known manner. The guide roller (see FIG. 1) is dismantled, as are the back rests 4 and the warp beam 2. The warp thread present has been cut open between reed and breast beam.

FIG. 3 shows a second dismantling stage. The heald frame stack 6 is disconnected from the linkage system 7. The warp beams are lifted up by jacks 17 and are arranged so that they can be removed from the warp thread bobbins. Each warp thread bobbin is connected to a strap 18 arranged in an allocated eye on a lifting apparatus (see below). Tongues on the warp beams are mounted to facilitate the drawing-out of each beam from respective bobbins. The superstructure 8 and the linkage system 7, as well as the breast beam and cloth beam systems, retain their positions in the weaving machine framework. The lifting apparatus is driven to the side in the direction of the arrow P and onwards to the separate station, as specified below, after all the bobbins have been suspended on straps 18.

Figure 4:
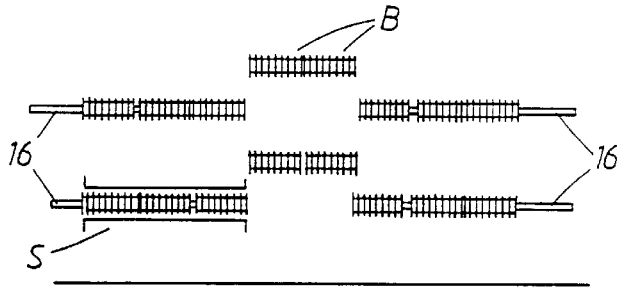
FIG. 4 shows, in a horizontal view, warp thread bobbins, and beams on which these bobbins are mounted.

FIG. 4 shows the drawing-out of the beams 16 from the bobbins B which, during the drawing-out, can be mounted in boards or equivalent apparatuses, after which the straps are applied to the bobbins in order to allow them to be lifted by the lifting apparatus.

Figure 5:
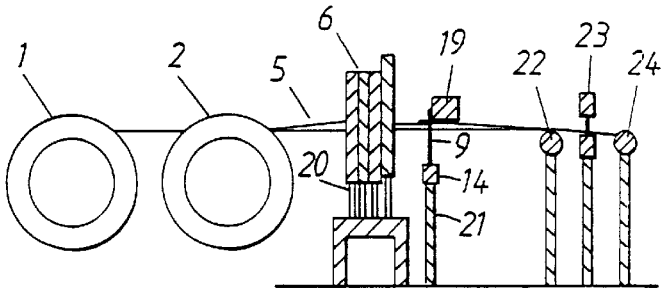
FIG. 5 shows, in longitudinal section, warp thread charging equipment separate from the weaving machine.

FIG. 5 shows the separate warp thread charging equipment for drawing-in warp thread in which the bobbins, the heald frames and reed have been placed in positions corresponding to those they assume in the weaving machine. The equipment comprises an automatic reeding device 19, air cylinders 20, members 21 for adjusting the height of the reed, guide roller 22 and an automatic taping device 23 for the free ends of the drawn-in warp thread 5. A brush roll 24 is also included. When putting the heald frames 6 into position, these are set on the air cylinders 20. The bobbins are arranged on bearing elements which correspond to the warp beams in the weaving machine. The insertion proceeds so that each warp thread is passed in through the heald frames in accordance with the instruction which applies to the warp in question. Each warp thread which is threaded through a heddle is introduced into the eye on the automatic reeding device 19. When the number of threads through the reed dents agrees with the instructions, the automatic reeding device draws these threads through. When the threads from a bobbin have been threaded through, the threads are stretched via the guide roller 22 through the automatic taping device 23 and to the brush roller 24. The components 22, 23 and 24 have a width which is 250 mm in the case shown. The brush roller 24 is turned round so that the warp is stretched. A control button for pattern control is actuated and a first heald frame of the heald frames comes up. A weft thread can then be drawn in through the shed which has thus been formed. An operating button for pattern stepping is depressed and a second heald frame comes up, after which a second weft thread is drawn in through the shed. This is repeated for each heald frame. A check is made to ensure that the warp thread is correctly drawn in and that the warp is stretched. This check is carried out in the form of a visual control. A plastic film is thereafter laid under and over the warp in the automatic taping device. The above procedure is repeated until all the bobbins are ready. Warp thread magazines, heald frames and reed, together with warp which has been thus introduced, can be transported back to the weaving machine in the reverse order to what has been described above. The components in question are placed in their positions in the weaving machine according to FIG. 1. The weaving machines and the warp thread drawing-in equipment can have a number of compatible and exchangeable warp thread magazines, heald frames and reeds, which are alternated between one or more weaving machines and the warp thread drawing-in equipment.

Figure 5A:
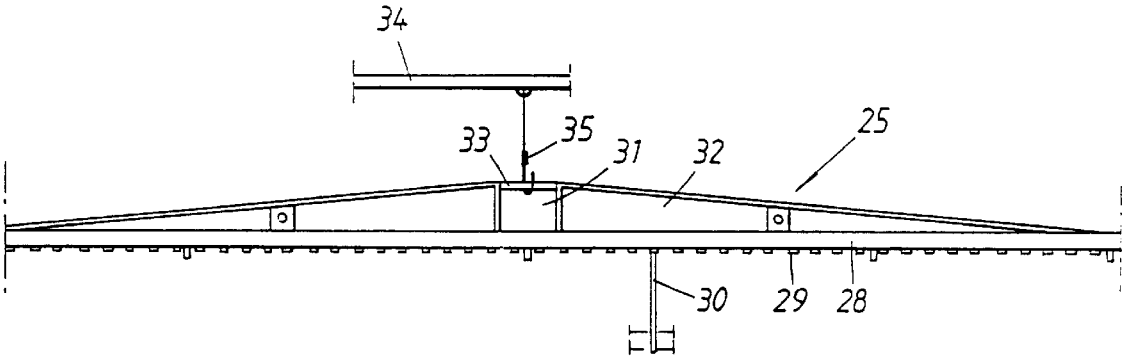
Figure 6:
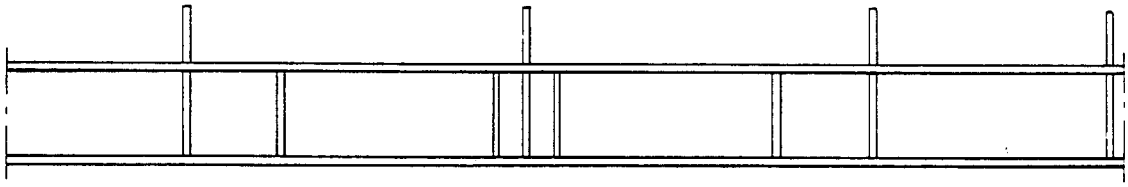
Figure 7:
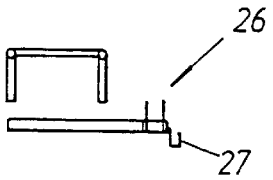

FIGS. 5*a,* 6 and 7 show the basic structure of a lifting yoke according to the invention. The lifting yoke 25 comprises clamping attachments 26 for the heald frames. A lifting hook 27 for the reed is also included. The lifting unit comprises a bar 28 on which a number of lifting eye bolts 29 are arranged, this number agreeing with the number of bobbins. In accordance with the above, each bobbin is suspended in a strap 30 of a known type. The lifting apparatus comprises, in addition to the said bar, bearing parts 31, 32. The lifting yoke can be lifted in a lifting part 33 using a traverse crane or the like. The lifting unit or the lift stand has a weight of about 900 kg and is arranged to be able to lift components (bobbins, heald frames, reed) of about 4 tons. A traverse crane is symbolized by 34, and the lifting function of the traverse crane is symbolized by 35. The lifting unit has a length which essentially corresponds to the length of the width of the weaving machine (15 to 30 meters or more).

Figure 8:
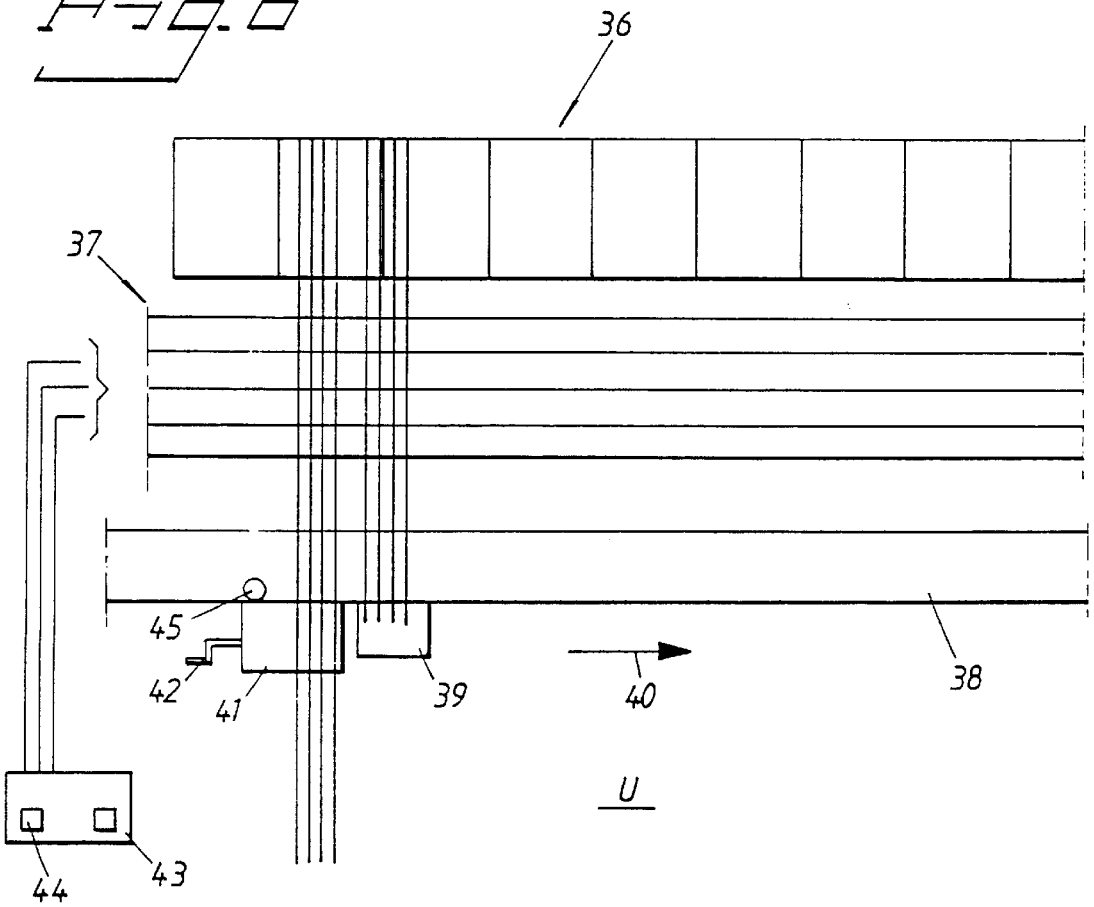
FIG. 8 shows, in a horizontal view, a known automatic reeding device and a control carriage simulating a cloth beam function in the weaving machine.
Figure 9:
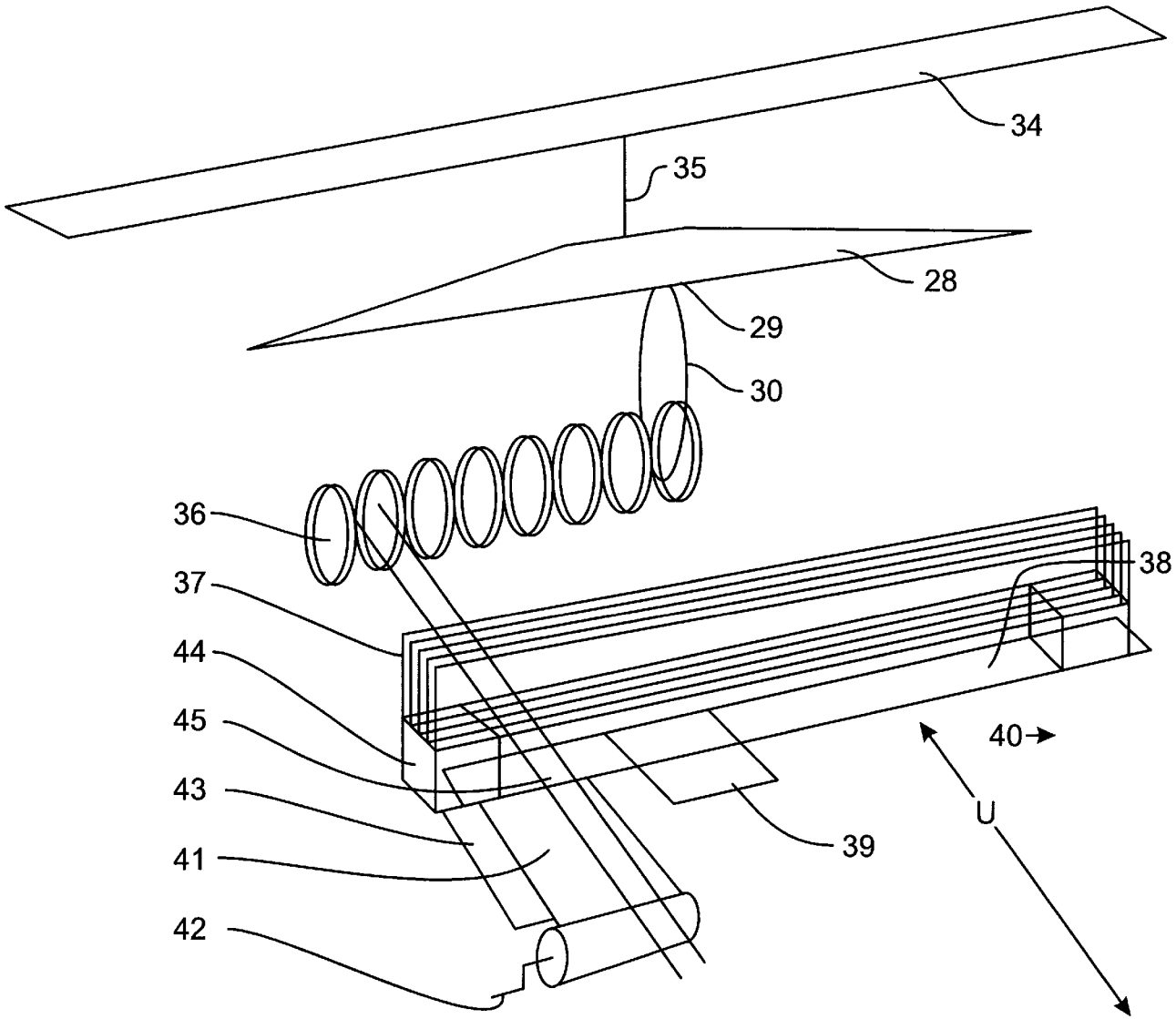
FIGS. 9 and 10 show three dimensional views of the lifting apparatus and the warp thread drawing-in equipment.
Figure 10:
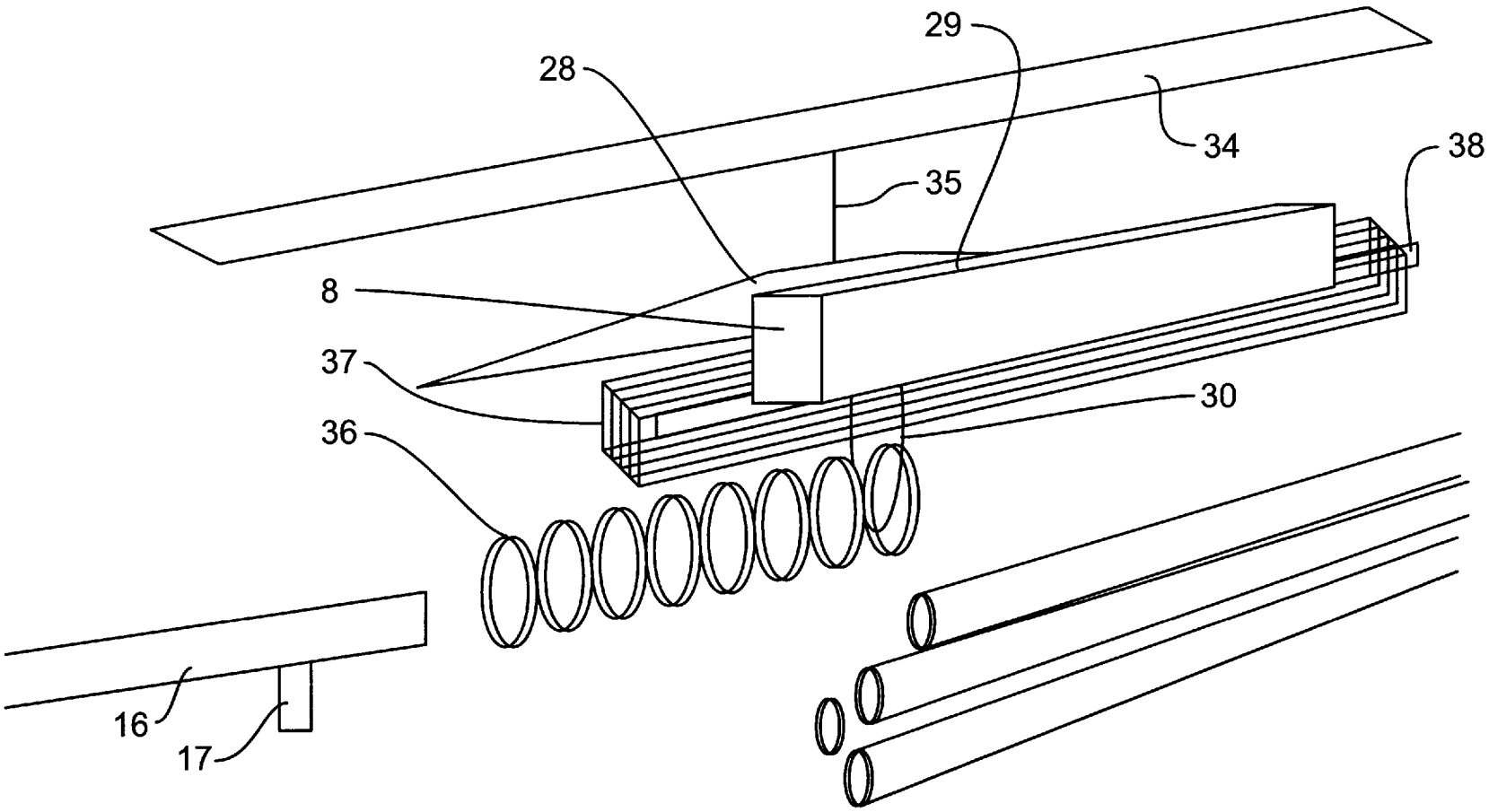

In FIGS. 8, 9 and 10 the bobbins, the heald frames and the reed are shown by 36, 37 and 38, respectively. An automatic reeding device is shown by 39. The automatic reeding device can be moved in steps along the entire width 40 of the reed. The automatic reeding device is previously known and is used in connection with the abovementioned TEXO machines. There is also a control carriage 41 which can be driven or moved in steps in the said width direction 40. The carriage is used to check the introduction into the heald frames (heddles), and a fixing device is shown by 42. A control panel 43 for controlling the positions of the heald frames in accordance with the above comprises manoeuvring members 44 for the control. A weft thread arrangement 45 is arranged on the carriage 41 for filling weft thread in sheds which are created by the heald frame actuation. In front of the reed there is a free space U for the personnel carrying out the work, which can start from one end of the reed and be carried out in stages towards the other end of the reed. A small number of threads are drawn in at a time and are checked. In total, about 60,000 warp threads can be drawn into the warp thread arrangement. Some 50 threads are drawn in and checked in each stage.

The invention is not limited to the embodiment illustrated above by way of example, but can be modified within the scope of the following patent claims and the inventive concept.

I claim:

1. A method of warp thread drawing-in for warp thread machines having at least one warp thread magazine, a heald frame, and a reed, said method comprising the steps of:

placing said warp thread magazine, said heald frame and said reed from said warp thread machine on a warp thread charging device separated from said warp thread machine;

passing warp thread groups, comprising one or more warp threads, in stages through a respective heddle of a heald frame;

assigning each of said warp thread groups a space in the reed;

drawing each of said warp thread groups through its respective space with an automatic reeding device, said automatic reeding device adapted for being movable along a width of said reed as the drawing step is carried out;

transferring said warp thread magazine, said heald frame and said reed from said warp thread charging device to said warp thread machine and returning said warp thread magazine, heald frame and reed to operational positions in said warp thread machine.

2. A method according to claim 1 further comprising the steps of:

checking the step of drawing each of said warp thread groups through its respective space by means of a control unit, said control unit simulating a cloth beam function where a number of threads placed in the heald frames and the reed are mounted on said control unit for control purposes, and moving said control unit along the width of the reed as the checking step is carried out.

3. A method according to claim 1 further comprising the steps of:

causing said heald frames to perform shedding movements, and passing weft threads through said control unit at the respective part of a weave width.

4. A method according to claim 1 further comprising the step of removing a warp thread draft, said warp thread magazine, said heald frame and said reed from said warp thread machine.

5. A method according to claim 1, wherein said warp thread machine includes warp thread machine beams and wherein said warp thread magazine consists of bobbins, said method further comprising the steps of setting up said bobbins in boards, uncovering warp thread machine beams while in said warp thread machine, and pushing said beams through central openings in said bobbins.

6. A method according to claim 5 further comprising the step of lifting said warp thread beams with jacks.

7. Warp thread charging equipment separate from a warp thread machine, said warp thread charging equipment comprising means for receiving warp thread magazines, heald frames and reeds adapted to be compatible with said warp thread machine, means for warp thread charging, and means for removing said warp thread magazines, said heald frames and said reeds for returning to said warp thread machine.

8. Warp thread charging equipment according to claim 7, further comprising a free space located in front of said reeds received in said warp thread charging equipment, and an automatic reeding device accessible from the free space and capable of being driven along the entire width of said reeds.

9. Warp thread charging equipment according to claim 7, further comprising a control unit, adapted for being movable along the entire width of said reeds, for checking the drawing-in of warp thread groups, said control unit simulating a cloth beam function where a number of warp threads placed in the heald frames and the reed are mounted on said control unit for control purposes.

10. Warp thread charging equipment according to claim 7 wherein said heald frames are received in said warp thread charging equipment and adapted to make shedding movements whereby weft threads can be introduced into sheds created from shedding movements.

11. Warp thread charging equipment according to claim 7 further comprising a lifting unit having a first member for holding said heald frames, a second member for holding said reeds, and a third member for holding said warp thread magazines; said lifting unit capable of being lifted by a crane, truck, or other lifting device.

12. Warp thread charging equipment according to claim 7 wherein said first member comprises clamp attachments for said heald frames, said second member comprises at least one lifting eye bolt for lifting and holding said reeds, and said third member comprises bearing means which cooperates with said bobbins of said warp thread magazines.

13. Warp thread charging equipment according to claim 12 wherein said bearing means are eyes for belt straps and a number of lifting eye bolts equals a number of bobbins.

14. Warp thread charging equipment according to claim 7 further comprising at least one air cylinder for recieving said heald frame.

15. Warp thread charging equipment according to claim 7 further comprising an adjustment member for adjusting the height of the reed on said warp thread charging device.

16. Warp thread charging equipment according to claim 7 further comprising guide rollers for stretching warp threads.

17. Warp thread charging equipment according to claim 16 further comprising a brush roll for acting on said warp threads.

18. Warp thread charging equipment according to claim 7 further comprising an automatic taping device.

* * * * *